US007036714B2

(12) United States Patent
Walsh et al.

(10) Patent No.: US 7,036,714 B2
(45) Date of Patent: May 2, 2006

(54) CARTON BLANK, CARTON AND METHOD OF FORMING THE CARTON

(75) Inventors: Joseph C. Walsh, Boulder, CO (US); Robert L. Conatser, Longmont, CO (US); Raymond S. Kastanek, Longmont, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 202 days.

(21) Appl. No.: 09/972,575

(22) Filed: Oct. 5, 2001

(65) Prior Publication Data

US 2002/0011515 A1 Jan. 31, 2002

Related U.S. Application Data

(63) Continuation-in-part of application No. 09/607,197, filed on Jun. 28, 2000, now Pat. No. 6,386,438.

(60) Provisional application No. 60/244,716, filed on Oct. 30, 2000.

(51) Int. Cl.
*B65D 3/00* (2006.01)

(52) U.S. Cl. ..... 229/117.27; 229/160.1; 229/125.62; 229/217; 229/234; 229/231; 229/219

(58) Field of Classification Search ..... 229/117.27, 229/125.42, 160.1, 217, 228, 234, 125.09, 229/231, 117.3, 219; 53/449
See application file for complete search history.

(56) References Cited

U.S. PATENT DOCUMENTS 1,907,067 A 5/1933 Hartmann
2,010,863 A 8/1935 Johnson
2,421,141 A * 5/1947 Carr ..... 229/231
2,434,756 A * 1/1948 Brooks ..... 229/217
2,549,582 A 4/1951 Dunning
2,583,211 A * 1/1952 Fleming ..... 229/125.09
2,848,153 A 8/1958 Geiger, Sr.
2,881,967 A 4/1959 Ringler
2,926,832 A * 3/1960 Negoro ..... 229/121
2,944,726 A 7/1960 McCauley
3,073,501 A * 1/1963 Williamson ..... 229/125.09
3,133,689 A * 5/1964 Rossi ..... 229/221
3,146,936 A * 9/1964 Hodapp ..... 229/231
3,168,233 A * 2/1965 Ignell ..... 229/217
3,187,987 A * 6/1965 Graybill ..... 229/125.09
3,259,297 A * 7/1966 Kalajian ..... 229/103.1
3,347,446 A 10/1967 Guyer et al.
3,484,034 A 12/1969 Sternau
3,944,066 A * 3/1976 Niepmann ..... 206/268
4,284,197 A * 8/1981 Meyers ..... 229/228
4,431,129 A * 2/1984 Froom ..... 229/125.09
4,565,315 A * 1/1986 Wagner et al. ..... 229/125.09
4,913,292 A 4/1990 Field
4,948,038 A * 8/1990 Moeller ..... 229/146

(Continued)

*Primary Examiner*—Tri M. Mai
(74) *Attorney, Agent, or Firm*—Womble Carlyle Sandridge & Rice, PLLC

(57) ABSTRACT

A carton blank having an outer layer of a relatively rigid material, a first inner layer of a relatively rigid material superposed over a portion of the outer layer and a second inner layer of a relatively flexible layer of a fluid impervious material is provided with first and second weakened portions so that, after a carton has been formed from the carton blank, filled with a desired material and sealed, the first weakened portion may be broken to form a flip top lid which when moved in an arcuate path will gradually sever the second weakened portion to form an opening in the carton so that an amount of the desired material may be removed from the carton. The carton also may include a feature which allows the flip top lid to be securely re-closed after initial opening of the lid.

7 Claims, 15 Drawing Sheets

OTHER PUBLICATIONS 4,953,707 A * 9/1990 Wein ..... 229/125.09
5,044,503 A * 9/1991 Wein ..... 229/122
5,141,150 A 8/1992 Plaessmann
5,314,114 A * 5/1994 Stone ..... 229/225
5,328,091 A 7/1994 Koss
5,373,960 A 12/1994 Gunn et al.
5,402,933 A * 4/1995 Behrmann ..... 229/231
5,505,374 A 4/1996 Stone
5,515,996 A 5/1996 Stone
5,642,599 A 7/1997 Tisma
5,788,102 A 8/1998 Hall et al.
5,810,250 A * 9/1998 Stone et al. ..... 229/215
5,857,614 A 1/1999 Walsh
5,875,963 A 3/1999 Stone et al.
5,911,359 A 6/1999 Stone et al.
5,947,368 A * 9/1999 Thresher et al. ..... 229/208
5,957,280 A 9/1999 Focke et al.
6,152,360 A * 11/2000 Block et al. ..... 229/215
6,195,959 B1 3/2001 Tisma
6,223,507 B1 5/2001 Tisma

* cited by examiner

CARTON BLANK, CARTON AND METHOD OF FORMING THE CARTON

This application is a continuation-in-part of U.S. patent application Ser. No. 09/607,197 filed Jun. 28, 2000, now U.S. Pat. No. 6,386,438 for CARTON BLANK, CARTON AND METHOD OF FORMING THE CARTON of Walsh et al. and claims the benefit of U.S. provisional patent application Ser. No. 60/244,716 filed Oct. 30, 2000, for CARTON BLANK, CARTON AND METHOD OF FORMING THE CARTON of Walsh et al., both of which are hereby incorporated by reference for all that is disclosed therein.

FIELD

The disclosure herein is directed generally to a carton blank and a carton formed therefrom.

BACKGROUND

In order to protect moisture sensitive materials in a carton, there have been many kinds of fluid impervious cartons developed to protect such moisture sensitive materials from deleterious elements such as the humidity in the air. The vast majority of these leakproof cartons have an outer layer formed from a relatively rigid material and an inner layer formed from a relatively flexible fluid impervious material to provide the moisture protection. When it is desired to remove an amount of the material in the carton, it is necessary to open both the outer and inner layers. It is desirable that an opening be formed in both the outer and inner layers at the same time. Also, it is desirable that such an opening be located so that it is not necessary to make an oversized carton so that none of the material in the carton is spilled during the opening thereof. Another desired advantage is that the structures associated with making the opening be of a nature that such structures may be returned to substantially the original position to further protect the material remaining in the carton.

SUMMARY

A carton blank having an outer layer of a relatively rigid material, a first inner layer of a relatively rigid material superposed over a portion of the outer layer and a second inner layer of a relatively flexible layer of a fluid impervious material is provided with first and second weakened portions so that, after a carton has been formed from the carton blank, filled with a desired material and sealed, the first weakened portion may be broken to form a flip top lid which when moved in an arcuate path will gradually sever the second weakened portion to form an opening in the carton so that an amount of the desired material may be removed from the carton.

The carton also may include a feature which allows the flip top lid to be securely re-closed after initial opening of the lid. The re-closing feature may include a hinge member which is originally formed within a wall of the container. A portion of the hinge member may be attached, e.g., by gluing, to a portion of the lid such that, when the lid is initially opened, the hinge member is severed from the container wall, thus leaving a hole in the wall. When the lid is re-closed, the hinge member is able to engage within the opening formed in the container wall, thus releasably securing the lid in the closed position. Alternatively, the hinge may be retained on the container wall while a panel portion is removed from the wall via attachment to the lid. In this manner, when the lid is re-closed, the panel portion on the lid may engage with the hinge portion located on the container wall in order to releasably secure the lid in the closed position.

BRIEF DESCRIPTION OF THE DRAWINGS

Illustrative and presently preferred embodiments are illustrated in the accompanying drawings in which.

DETAILED DESCRIPTION

Figure 1:
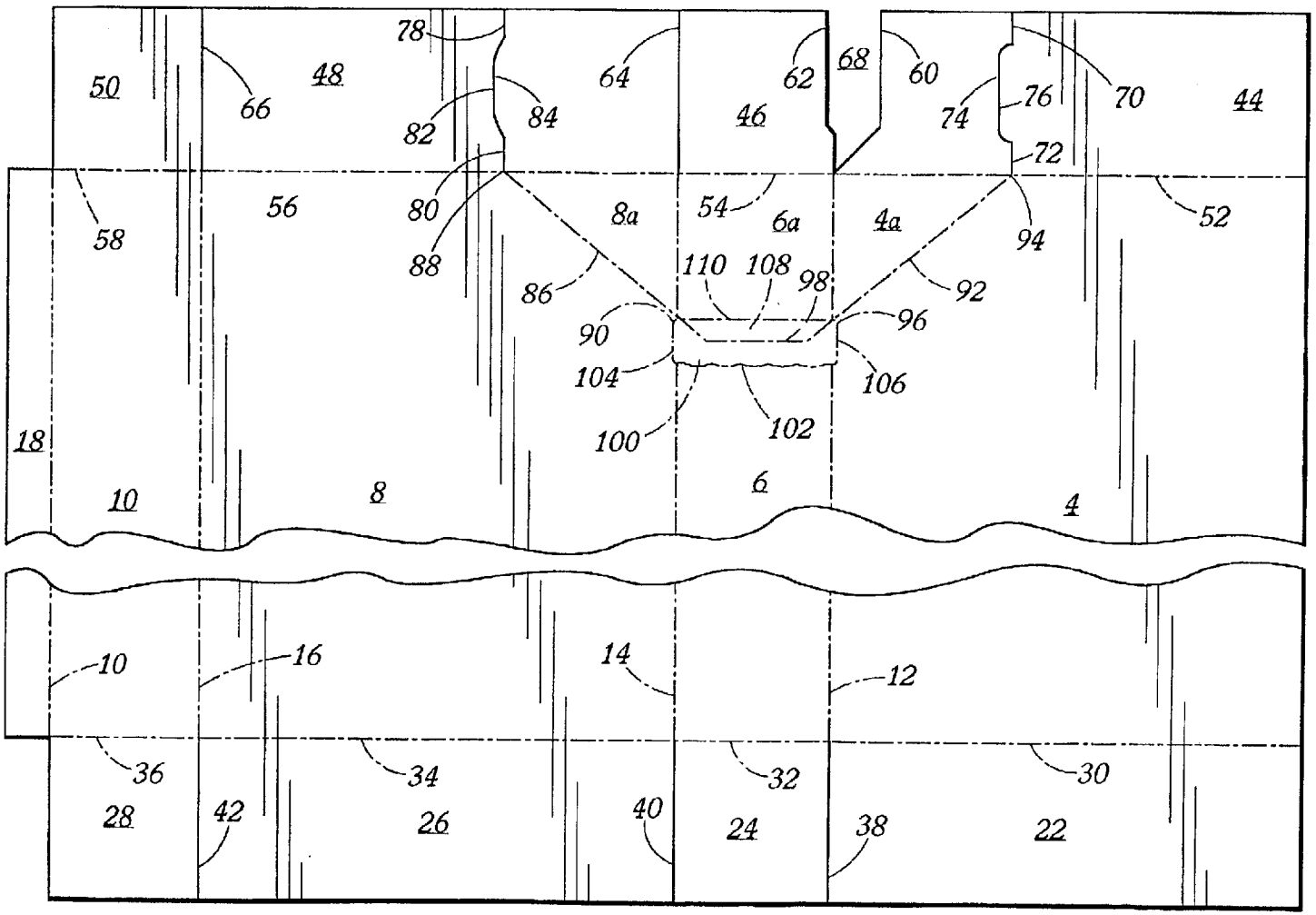
FIG. 1 is a top plan view of the outer surface of a carton blank.

FIGS. 1–22, in general, illustrate a method of opening and closing a container 280, 480. The method includes providing the container 280, 480 having a body portion having at least one wall 322, 422; a lid 382, 482 movably attached to the body portion; a panel 352, 354, 454 formed in the at least one wall of the body portion. The panel 352, 354, 454 may be attached to the lid 382, 482. The method may further include moving the lid 382, 482 to an open position by applying an opening force thereto, wherein the opening force causes the panel 352, 354, 454 to separate from the at least one wall 322, 422, thereby forming a hole 356, 456 in the at least one wall 322, 422; moving the lid 382, 482 to a closed position by applying a closing force thereto and releasably retaining the lid 382, 482 in the closed position by engaging at least a portion of the panel 352, 354, 454 with at least a portion of the wall 322, 422.

FIGS. 1–22, further illustrate, in general, a container 280, 480 having a body portion having at least one wall 322, 422 and a lid 382, 482 movably attached to the body portion. The container 280, 480 may include a first condition before the container 280, 480 has initially been opened, a second open condition and a third re-closed condition. In the first condition, a panel 352, 354, 454 is attached to both the at least one wall 322, 422 of the body portion and the lid 382, 482. In the second condition, the panel 352, 354, 454 remains attached to the lid 382, 482 but has been removed from the at least one wall member 322, 422, thus leaving a hole 356, 456 in the at least one wall 322, 422. In the third condition, at least a portion of the panel 352, 354, 454 is releasably engaged with at least a portion of the wall 322, 422.

FIGS. 1–22, further illustrate, in general, a method of opening and closing a container 280. The method may include providing the container 280 having a body portion having at least one wall 322; a lid 282 movably attached to the body portion and a hinge 352 movably attached to the lid 282. The method may further include moving the lid 282 to an open position by applying an opening force thereto; moving the lid 282 to a closed position by applying a closing force thereto and releasably retaining the lid 282 in the closed position by engaging at least a portion of the hinge 352 with at least a portion of the wall 322.

FIGS. 1–22, further illustrate, in general a container 282 capable of moving between an open condition and a closed condition. The container 282 may include a body portion having at least one wall 322; a lid 282 movably attached to the body portion and a hinge 352 movably attached to the lid 282. In the closed condition, at least a portion of the hinge 352 is engaged with at least a portion of the wall 322.

FIGS. 1–22, further illustrate, in general a method of opening and closing a container 280, 480. The method may include providing the container 282 having a body portion having at least one wall 322, 422; a lid 282, 382 movably attached to the body portion; a hinge portion 352, 452 and a stationary portion 354, 422. The hinge portion 352, 452 is movably attached to the stationary portion 354, 422 via a score line 350, 441. The hinge portion 352, 452 is aligned with the stationary portion 354, 422. The method further includes moving the lid 282, 482 to an open position by applying an opening force thereto, wherein the opening force causes the hinge portion 352, 452 to misalign with the stationary portion 354, 422; moving the lid 282, 482 to a closed position by applying a closing force thereto and using the hinge portion 352, 452 to releasably retain the lid 282, 482 in the closed position.

FIGS. 1–22, further illustrate, in general a container 280, 480 capable of moving between an open condition and a closed condition. The container 280, 480 may include a body portion having at least one wall 322, 422; a lid 282, 482 movably attached to the body portion; a hinge portion 352, 452 and a stationary portion 354, 422. The hinge portion 352, 452 is movably attached to the stationary portion 354, 422 via a score line 350, 441. The container 280, 480 includes a first condition before the container 280, 480 has initially been opened, a second open condition and a third re-closed condition. In the first condition, the hinge portion 352, 452 is aligned with the stationary portion 354, 422. In the second condition, the hinge portion 352, 452 is misaligned with the stationary portion 354, 422. In the third condition, the hinge portion 352, 452 releasably retains the lid 282, 482 in the re-closed condition.

Having thus described the container and method in general, they will now be described in further detail.

In FIG. 1, there is illustrated the outer surface of a carton blank 2. The carton blank 2 has an outer layer which comprises a generally rectangular sheet of a relatively rigid material such as paperboard, a composite materials comprising a plastic film laminated to paperboard or any other conventional material used in forming cartons and has a plurality of integral sidewall panels 4, 6, 8 and 10 which are joined together by fold lines 12, 14 and 16 and a glue tab panel 18 integral with the sidewall panel 10 and joined thereto by a fold line 20. A plurality of bottom panels 22, 24, 26 and 28 are integral with the sidewall panels 4, 6, 8 and 10 and are joined thereto by fold lines 30, 32, 34 and 36 and are separated from each other by cut lines 38, 40 and 42. A plurality of top panels 44, 46, 48 and 50 are integral with the sidewall panels 4, 6, 8 and 10 and are joined thereto by fold lines 52, 54, 56 and 58 and are separated from each other by cut lines 60, 62, 64 and 66. The cut lines 60 and 62 are spaced apart to form an opening 68 therebetween. The top panel 44 has a pair of spaced apart opposite fold lines 70 and 72 and an arcuate shaped perforated line 74 which, when broken, forms a tab portion 76. The top panel 48 has a pair of spaced apart opposite fold lines 78 and 80 and an arcuate shaped perforated line 82 which, when broken, forms a tab portion 84. A first weakened portion 86 has a first end point 88 in the fold line 56 and a second end point 90 in the fold line 14. A second weakened portion 92 has a first end point 94 in the fold line 52 and a second end point 96 in the fold line 12. A third weakened portion 98 extends between the second end points 90 and 96 and is shaped as a frustum of a V. As illustrated in FIG. 1, the weakened portions 86, 92 and 98 form portions 4*a*, 6*a* and 8*a* in the sidewall panels 4, 6 and 8. An opening tab 100 is formed in the sidewall panel 6 by a perforated line 102 and extensions 104 and 106 thereof which extensions 104 and 106 are parallel to but spaced slightly from portions of the fold lines 12 and 14. A tab portion 108 extends from a fold line 110 for purposes described below.

Figure 2:
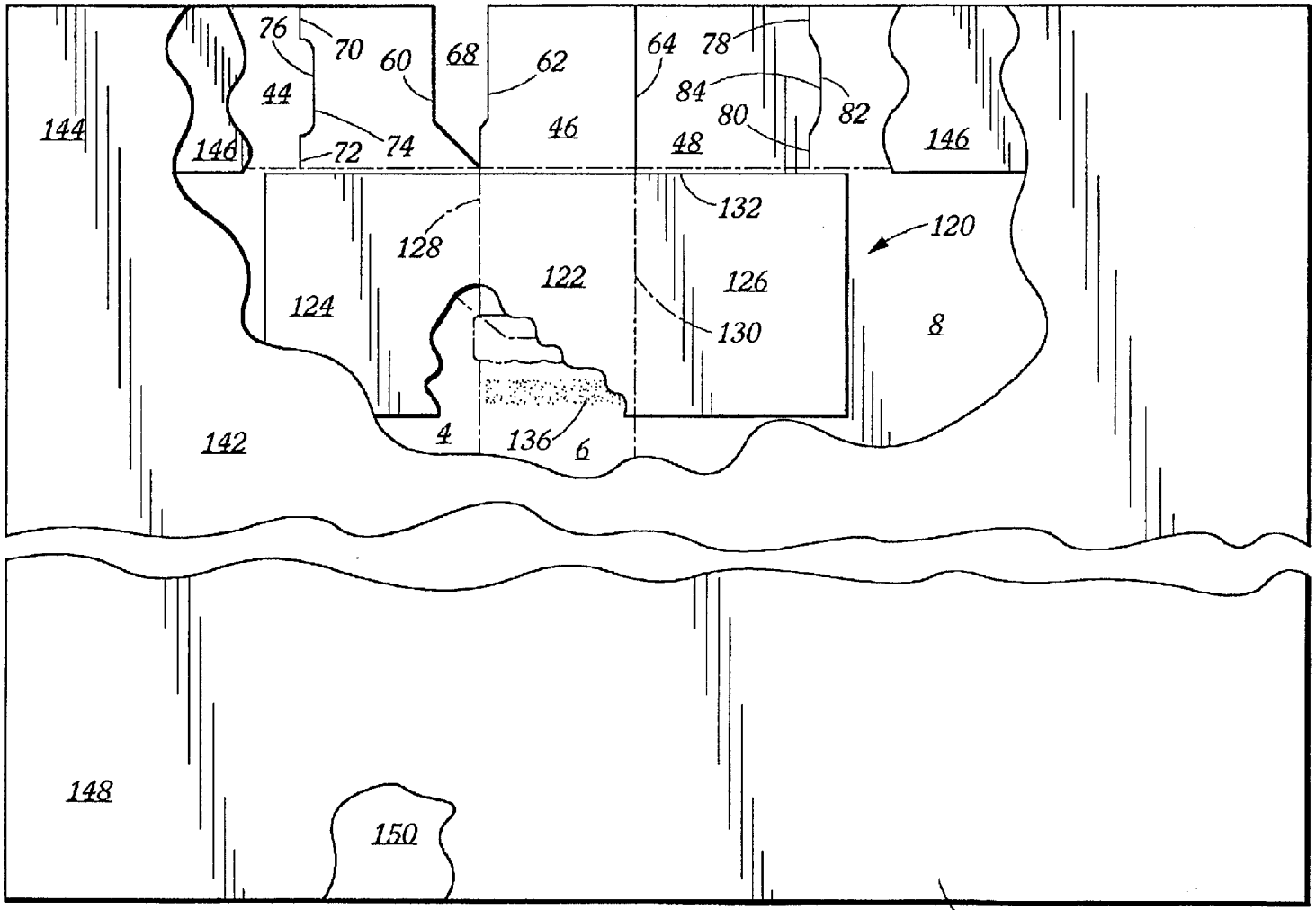
FIG. 2 is a top plan view of the inner surface of a carton blank with parts broken away.

In FIG. 2, there is illustrated the inner surface of a carton blank 2. The portions illustrated in FIG. 2 that correspond to FIG. 1 have been identified with the same reference numerals. A first inner layer comprising a generally rectangularly shaped insert 120 has a partial sidewall panel 122 superposed over a portion of the sidewall panel 6; a partial sidewall panel 124 superposed over a portion of the sidewall panel 4 and a partial sidewall panel 126 superposed over a portion of the sidewall panel 8. The partial sidewall panel 124 and the partial sidewall panel 126 are integral with the partial sidewall panel 122 and are joined thereto by the fold lines 128 and 130 which are substantially superposed over portions of the fold lines 12 and 14. The insert 120 has an upper edge 132 that is spaced slightly from the fold line 54 and portions of the fold lines 52 and 56 and a lower edge 134. The portion of the partial sidewall panel 122 adjacent to the lower edge 134 is secured to the opposite facing inner surface of the sidewall panel 6 by a suitable adhesive 136. The first inner layer or insert 120 is preferably formed from the same type of material as the outer layer.

A second inner layer of the carton blank 2 comprises a generally rectangular sheet 140 of a fluid impervious material comprising a central body portion 142 that is superposed over at least portions of the portions of the sidewall panels 4, 6, 8 and 10 located between but spaced slightly from the fold lines 52, 54, 56 and 58 and the fold lines 30, 32, 34 and 36 and a corresponding portion of the glue tab panel 18 and all of the insert 120. The generally rectangular sheet 140 is preferably formed from a plastic material, such as polyethylene, a kraft paper covered with polyethylene or other materials having similar characteristics. At least portions of the central body portion 142 are secured to facing portions of the insert 120 and the sidewall panels 4, 6, 8 and 10 and the glue tab panel 18. The generally rectangular sheet 140 has a top portion 144 that extends from the central body portion 142 and is superposed over at least portions of the top panels 44, 46, 48 and 50 and the glue tab panel 18. In one example of a preferred embodiment, the top portion 144 is superposed over and secured to an elongated strip 146 of a relatively flexible material, such as a kraft paper or other materials having similar characteristics. The generally rectangular sheet 140 had a bottom portion 148 that extends from the central body portion 142 and is superposed over at least portions of the bottom panels 22, 24, 26 and 28 and the glue tab panel 18. The bottom portion 148 is superposed over and secured to a strip 150 of a relatively flexible material as described above. In some instances, the strips 146 and 150 may be omitted so that the top 144 and bottom 148 portions comprise only portions of the sheet 140 of a fluid impervious material. As illustrated in FIG. 2, two of the edges of the generally rectangular sheet 140 are located in alignment with the edge of the glue tab panel 18 and the edge of the sidewall panel 4 but in some instances such edges may be offset a desired distance.

Figure 3:
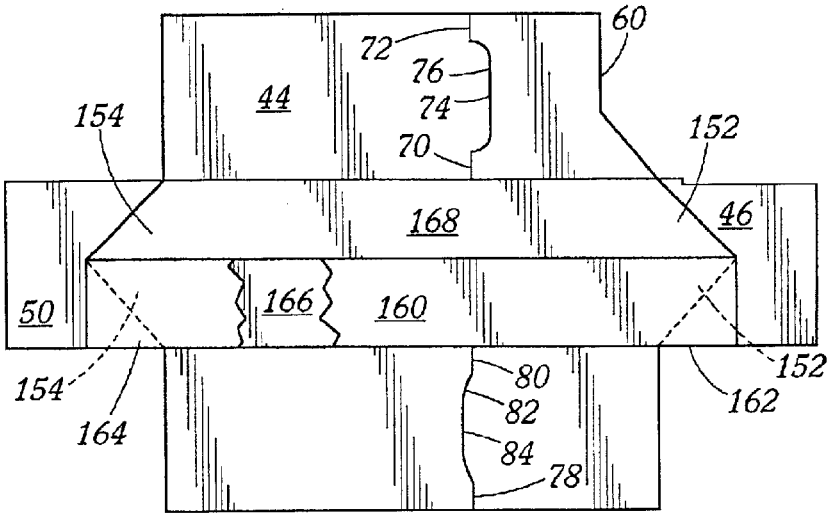
FIGS. 3–5 are top plan views illustrating different steps in the formation of the top portion of a carton from a carton blank.
Figure 4:
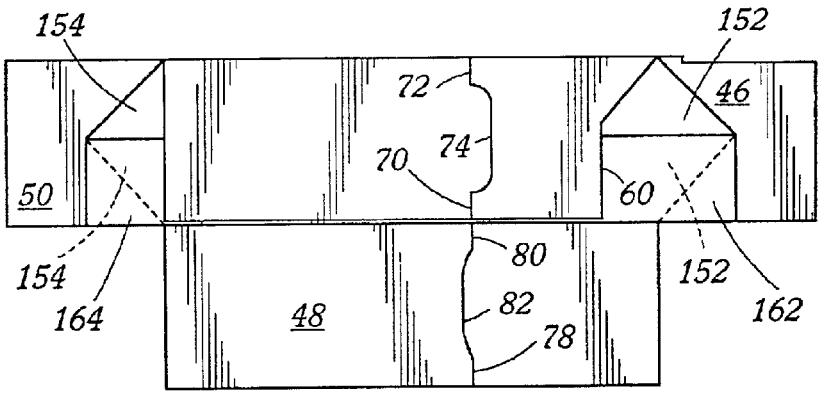
Figure 5:
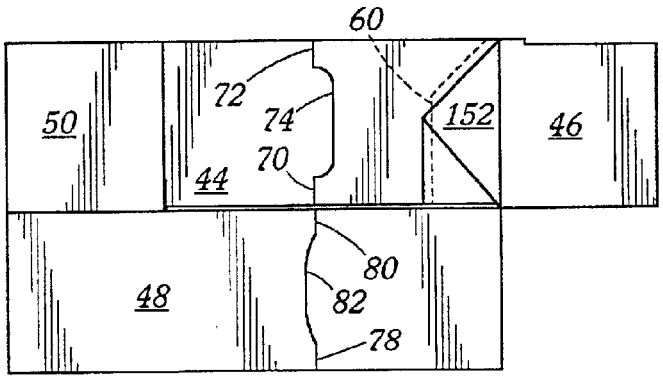

FIGS. 3–5 illustrate steps in forming a closed and sealed end for a carton formed from the carton blank 2 described in relation to FIGS. 1 and 2. The sidewall panels 4, 6, 8 and 10 are folded around the fold lines 12, 14 and 16 and secured together by a suitable arrangement between the glue tab panel 18 and a portion of the sidewall panel 4 or portions of the sheet 140 associated with the structures to form an open ended structure (not shown). The bottom panels 22, 24, 26 and 28 and the bottom portion 148 with or without the strip 150 have been folded and secured together to form a closed fluid impervious bottom end for the carton. The carton is then filled with a desirable material and the top portion 144 with or without the strip 146 has been folded and sealed together to form a closed fin joint. The fin joint is formed from the top portion 144 that extends upwardly from a common plane formed by the fold lines 52, 54, 56 and 58 and comprises portions of the generally rectangular sheet 140 that extend from the sidewall panels 4, 6, 8 and 10 to form an open top portion. The portions of the generally rectangular sheet adjacent to the open top portion are secured together to form two sealed together layers having a central section 160 and two opposite end sections 162 and 164. The extensions of the top portion 144 from the sidewall panels 4 and 8 are also formed into generally horizontal portions 166 and 168 that lie in a common plane generally parallel to the above-described common plane. The generally horizontal portions 166 and 168 comprise a single thickness of the generally rectangular sheet 140. The extensions of the top portion 144 from the sidewall panels 6 and 10 and the glue tab panel 18 are also formed into triangular end sections 152 and 154 illustrated in FIGS. 3 and 4 by two reference numerals which comprise two thicknesses of the generally rectangular sheet 140. The triangular end sections 152 and 154 also lie in a plane parallel to the common planes described above. As illustrated in FIG. 3, the central section 160 and the end sections 162 and 164 of the fin joint have been folded over so that they lie substantially in the common plane formed by the fold lines 52, 54, 56 and 58. Therefore, the fin joint has a central section comprising the central section 160 and the portions 166 and 168 and two opposite end sections comprising the end sections 162 and 164 and the triangular portions 152 and 154. In FIG. 4, the top panel 44 is folded around fold line 52 until it is superposed over a major portion of the central section comprising the central body portion 160 and the portions 166 and 168 but is not secured thereto. The top panel 50 is then folded around fold line 58 so that it is superposed over a portion of the top panel 44 and the end sections 154 and 164 are sandwiched in between. These portions are not adhesively secured together. The top panel 46, preferably at the same time, is folded around fold line 54 that it is superposed over a portion of the top panel 44 and the open portion formed by the cut line 60 and the end sections 154 and 162 are sandwiched in between. These portions are not adhesively secured together. The structure prior to folding over the top panel 46 is illustrated in FIG. 5. The top panel 48 is then folded around fold line 56 until it is superposed over the top panels 44 and 50 and the central portion of the top panel 44. At least the facing portions of the top panels 48, 46, 50 and 44 are secured together. The fold lines 78 and 80 are superposed over the fold lines 70 and 72 and the tab portions 76 and 84 extend in opposite directions.

Figure 6:
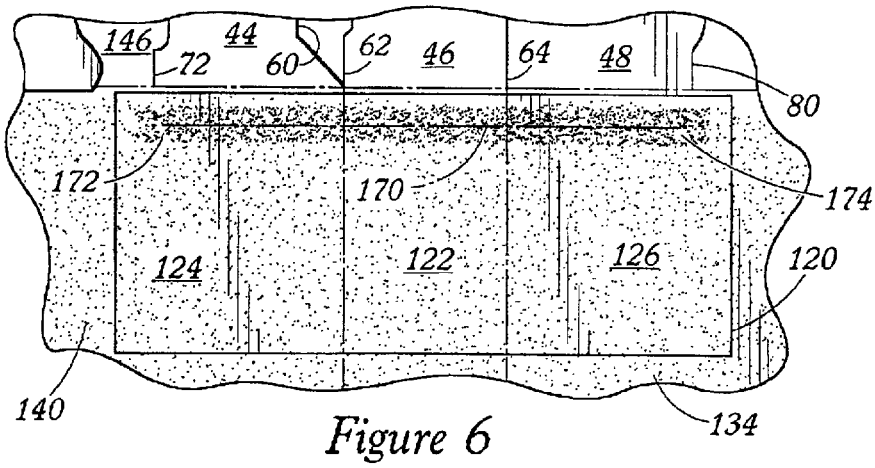
FIG. 6 is a enlarged portion of FIG. 5 illustrating one of the weakened portions.

In FIG. 6, there is illustrated part of the structures for forming the flip top lid for the carton as described below. The generally rectangular sheet 140 is superposed over the inner surface of the outer layer of the carton blank 2 of FIG. 2 and is secured thereto by a suitable adhesive illustrated by the dotted portion. The generally rectangular sheet 140 also is superposed over the generally rectangular first inner layer or insert 120. A weakened portion 170 having end portions 172 and 174 is formed in the generally rectangular sheet 140. In an exemplary preferred embodiment, the length of the weakened portion 170 between the end portions 172 and 174 is less than the distance between the fold lines 72 and 80 as illustrated in FIG. 6. The weakened portion 170 is surrounded by an adhesive, illustrated by the more heavily dotted area, to preserve the fluid tightness between the portion of the generally rectangular sheet 140 and the first inner layer or insert 120. The weakened portion 170 may comprise a cut line or a perforated line and may be formed using a heated cutting apparatus (not shown) so that, as the weakened portion 170 is made, the portions of the generally rectangular sheet 140 surrounding the weakened portion 170 are secured to the first inner layer or insert 120. In another exemplary embodiment, a coating of a suitable adhesive, such as a conventional hot or cold melt adhesive, may be used as long as the fluid impervious characteristic of the second inner layer or generally rectangular sheet 140 is maintained. The weakened portion 164 is preferably located as close as possible to the upper edge 132 of the first inner layer or insert 120 for purposes described below. The location of the weakened portion 164 as shown in FIG. 6 is for illustration purposes only.

Figure 7:
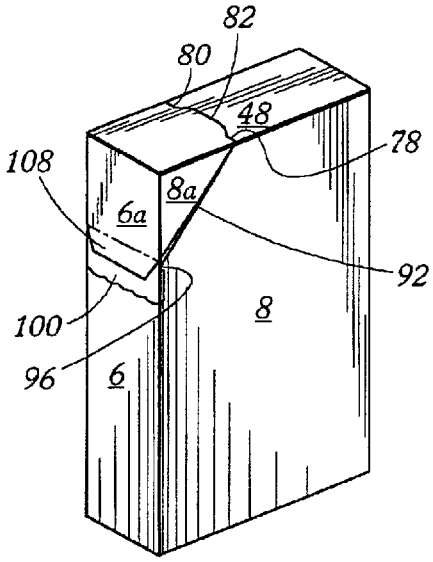
FIG. 7 is a perspective view of a closed carton.
Figure 8:
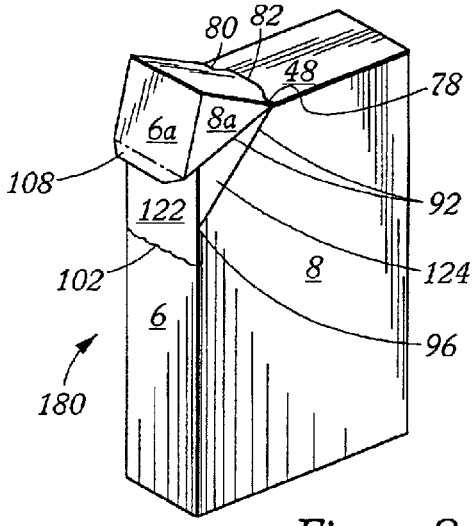
FIG. 8 is a perspective view of a partially opened carton.
Figure 9:
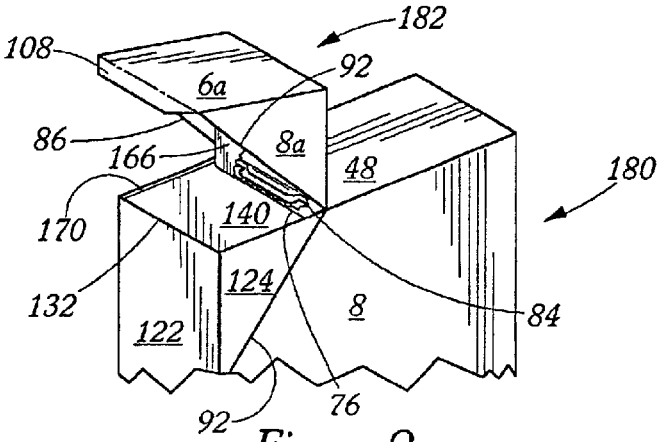
FIG. 9 is an enlarged perspective view of a opened carton wherein the flip top lid is being retained in an opened position.

A carton 180 formed from the carton blank 2 of FIGS. 1 and 2 and having its top portion formed as illustrated in FIGS. 3–5 is illustrated in FIGS. 7–9. In FIG. 7, the carton 180 is one that has been filled with the desired material as described above. In FIG. 8, the flip top lid 182 having portions 4*a*, 6*a* and 8*a* secured from the sidewall panels 4, 6 and 8 and the tab portion 108 has been partially opened. As illustrated in FIG. 8, the opening tab 100 has been removed by applying a force thereto at the fold line 14 and severing it along the perforated lines 104, 102, 98 and 106. Another force has been applied to the tab 108 to sever the outer layer along the perforated lines 86 and 92. At the same time, the force separates the weakened portion 170 since the portion 162 located between the folded over top panel 46 and the top panel 44 applies the force to the weakened portion 170. The tab portion 84 has separated along the score line 82 as the flip top lid 182 moves upwardly in a pivoted manner through an arcuate path defined by the fold lines 78 and 80. The pivotal movement of the flip top lid 182 is continued until the outer surface (not numbered) of the tab portion 84 faces the outer surface (not numbered) of the tab portion 76. This pivotal movement is generally about 120 degrees. In FIG. 9, the flip top lid 182 is held in an opened position by the cooperation between outer surfaces of the tab portions 76 and 84 which generally is about 90 degrees so that an amount of the desired material may be removed from the carton 180. After an amount of the desired material has been removed from the carton 180, a force is applied to the flip top lid 182 to return it generally to the position illustrated in FIG. 7 but with the opening tab 100 removed.

Figure 10:
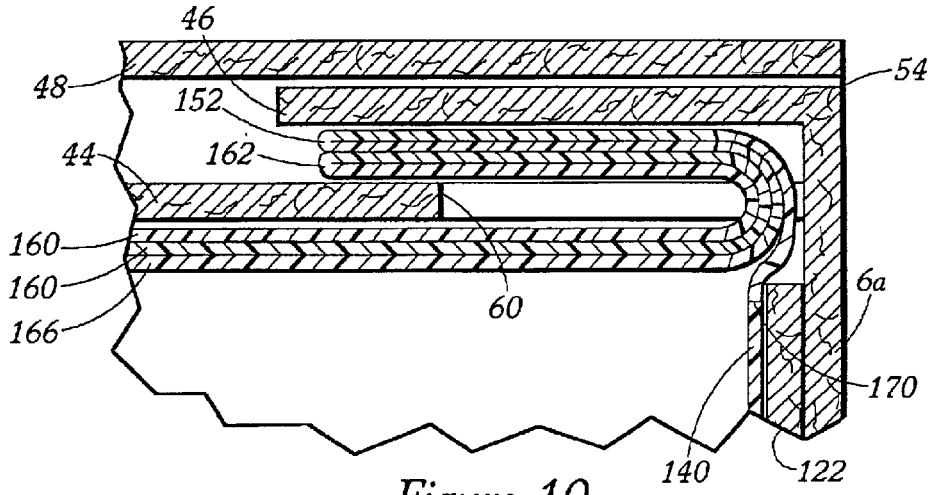
FIG. 10 is a schematic elevational view with parts in section of a portion of the top of a carton prior to the formation of the opening therein.
Figure 12:
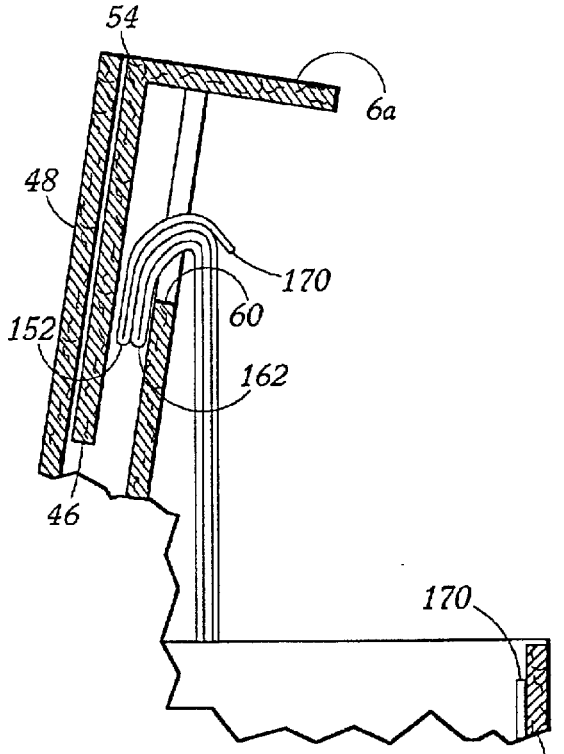
FIG. 12 is a schematic elevational view with parts in section and wherein the flip top lid is being held in the opened position.
Figure 11:
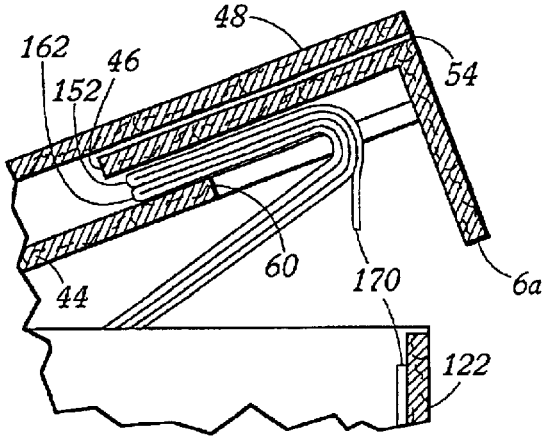
FIG. 11 is a schematic elevational view with parts in section and wherein the flip top lid has been formed and is partially opened.

FIGS. 10–12 illustrate the location of the various components at different times during the formation of the opening in the carton 180. In FIG. 10, the carton 180 has not been opened. In FIG. 11, the carton 180 has been partially opened. In FIG. 12, the carton 180 has been fully opened and the flip top lid 182 is being held in an opened position so that an amount of the desired material may be removed from the carton 180. In FIG. 12, the flip top lid 182 has been moved to a partially opened position. Part of the weakened portion 170 has been severed. The portion of the weakened portion 170 between the panels 6 and 6*a* and part of the weakened portion 170 between the panels 4 and 4*a* and 8 and 8*a* has been separated. Since the end sections of the fin joint are sandwiched between portions of the top panels 44 and 46, a force is applied to the end sections 152 and 162 and portions of the portions 166 and 168 of the fin joint to pull these portions downwardly through the opening 68 formed by the cut line 60. In FIG. 12, the weakened portion 170 has been completely severed and a large portion of the end sections 152 and 162 and the portions 166 and 168 of the fin joint have been moved through the opening 68. As described above, the contact between the outer surfaces of the tab portions 76 and 84 holds the flip top lid 182 in the opened position so that an amount of the desired material may be removed from the carton 180. In FIGS. 10–12, the strips 146 and 150 of a relatively flexible material are not shown but would be included in an exemplary preferred embodiment.

FIGS. 13–18 illustrate a carton 280. The carton 280 may be substantially identical to the carton 80 previously described with respect to FIGS. 1–12, except that the carton 280 is provided with a flip top lid 382 having a feature to allow the lid to be securely re-closed after initial opening, as will be described in further detail below. Because the carton 280 is similar in many aspects to the carton 80, the same reference numerals are used in FIGS. 13–18 to refer to like features illustrated in FIGS. 1–12.

Figure 13:
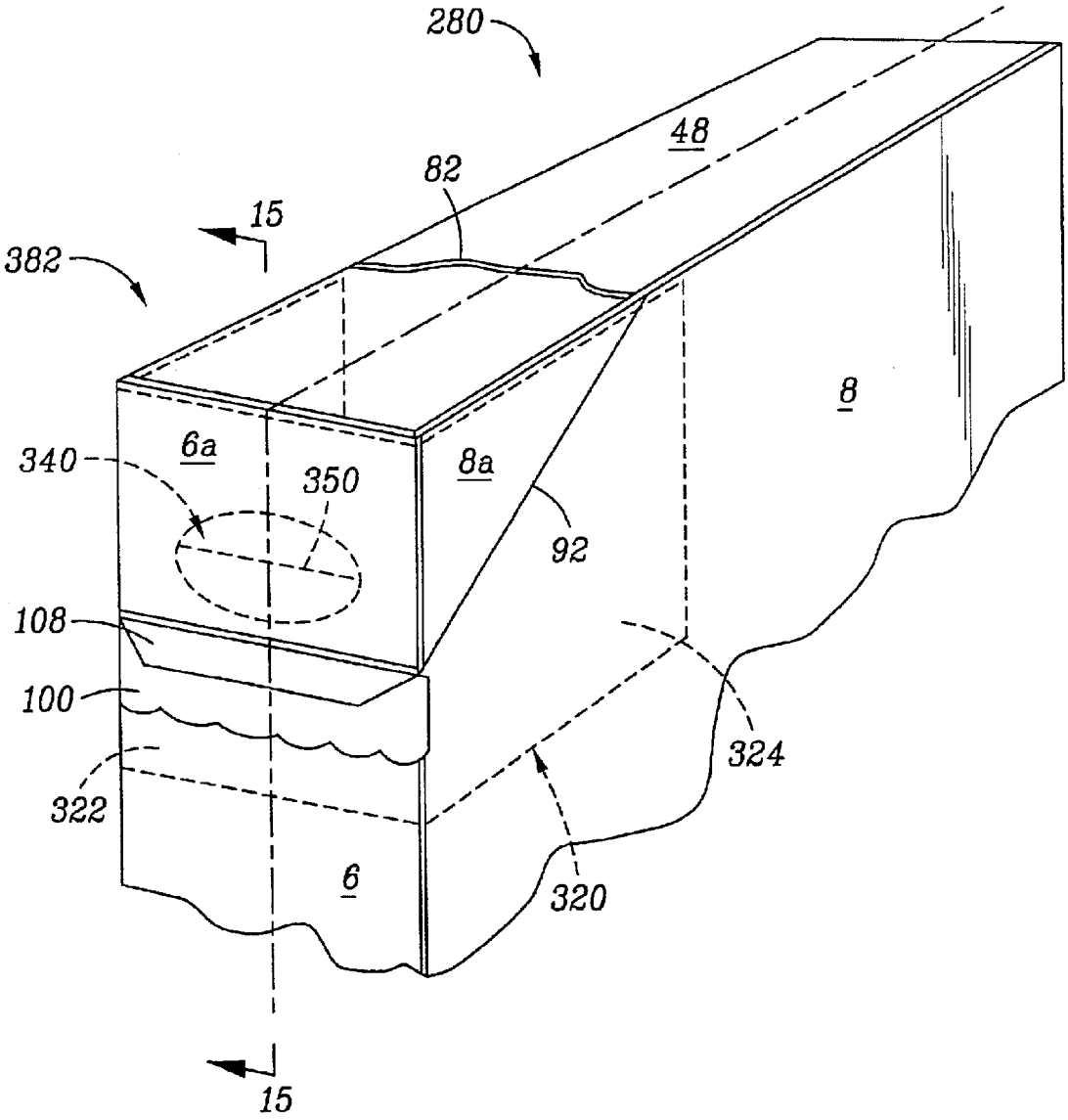
FIG. 13 is a partial perspective view of a closed carton having a stay closed feature.
Figure 14:
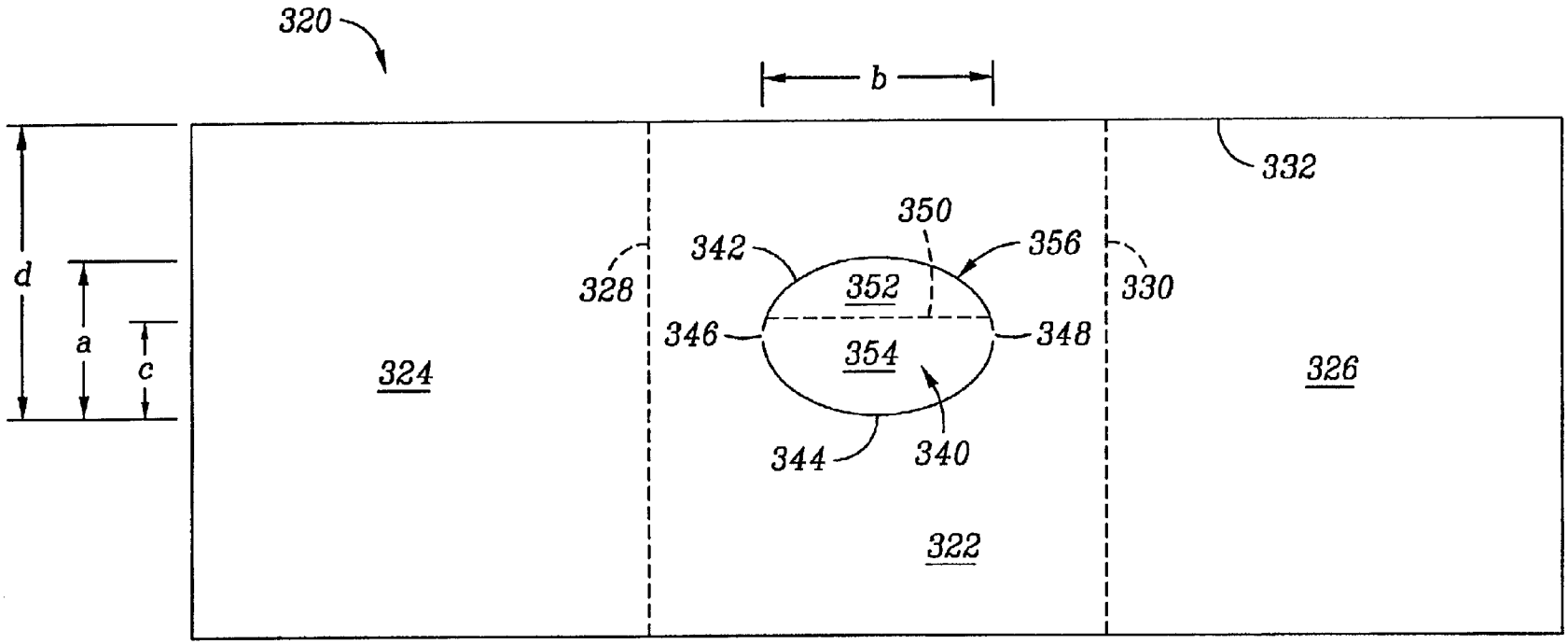
FIG. 14 is a plan view of an insert member forming a part of the carton of FIG. 13.

As noted above, the carton 280 may be formed in a substantially identical manner to that described with respect to the carton 80 previously described with respect to FIGS. 1–12. With reference to FIG. 13, the carton 280 may, however, include an insert member 320 which is modified relative to the insert member 120 previously described with respect to the carton 80. FIG. 14 illustrates the modified insert member 320 in further detail.

Referring now to FIG. 14, the insert member 320 may have a partial sidewall panel 322; a partial sidewall panel 324 and a partial sidewall panel 326. The partial sidewall panel 324 and the partial sidewall panel 326 may be integral with the partial sidewall panel 322 and may be joined thereto by the fold lines 328 and 330. The insert member 320 has an upper edge 332. The insert member 320 may, for example, be formed from the same material as previously described with respect to the insert member 120. A cutout portion 340 may be provided in the partial sidewall panel 322 of the insert member 320 as shown. The cutout portion 340 may generally be defined by an upper cut line 342 and a lower cut line 344. The cut lines 342, 344 may extend completely through the material forming the insert member 320 such that, together, the cut lines 342, 344 will form an opening 356 in the insert member 320 after the cutout portion 340 is removed, as will be described in further detail herein. A pair of uncut areas may be located between the cut lines 342 and 344 forming retention tabs 346 and 348. The retention tabs 346, 348 serve to retain the cutout portion to the remainder of the insert member 320 during manufacture of the carton 280 in a manner as will be described in further detail herein.

With continued reference to FIG. 14, a score line 350 may be provided as shown, dividing the cutout portion 340 into an upper (as viewed in FIG. 14) hinge portion 352 and a lower stationary portion 354. The cutout portion 340 may, for example, have a height "a" of about 1.0 inch and a width "b" of about 1.5 inches and may, for example, be generally elliptical is shape. The score line 350 may, for example, be located a distance "c" of about 0.6 inch above the lower edge of the cutout 340. The lower edge of the cutout 340, in turn, may be located a distance "d" of about 1.85 inch below the upper edge 332 of the insert member 320.

The insert member 320 may be assembled into the carton blank 2 in substantially the same manner as previously described with respect to the insert member 120, see FIG. 2. When assembling the insert member 320, however, adhesive 360, FIG. 15, may be supplied between the insert member stationary portion 354, FIG. 14, and the carton blank sidewall panel 6, FIG. 2. In addition, although the rectangular sheet 140 may be secured to the insert member 320 around the periphery of the cutout portion 340, the sheet 140 is not secured to the cutout portion 340 itself. Securing the rectangular sheet 140 to the insert member 320 and to the remainder of the carton blank 2 may be accomplished using a conventional glue or by any other conventional attachment mechanism.

Figure 15:
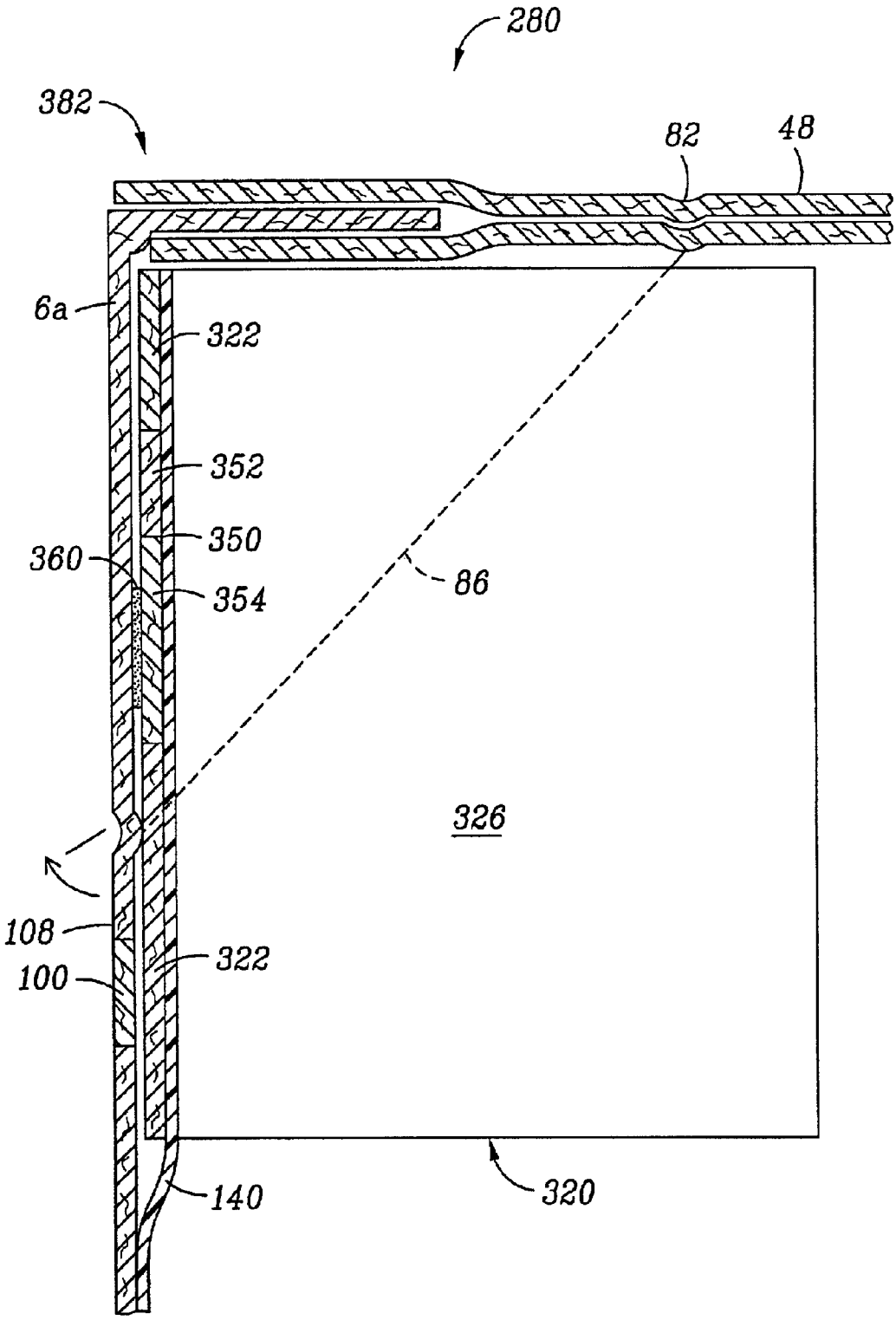
FIG. 15 is a partial cross-sectional view taken along the line 15—15 in FIG. 13.
Figure 16:
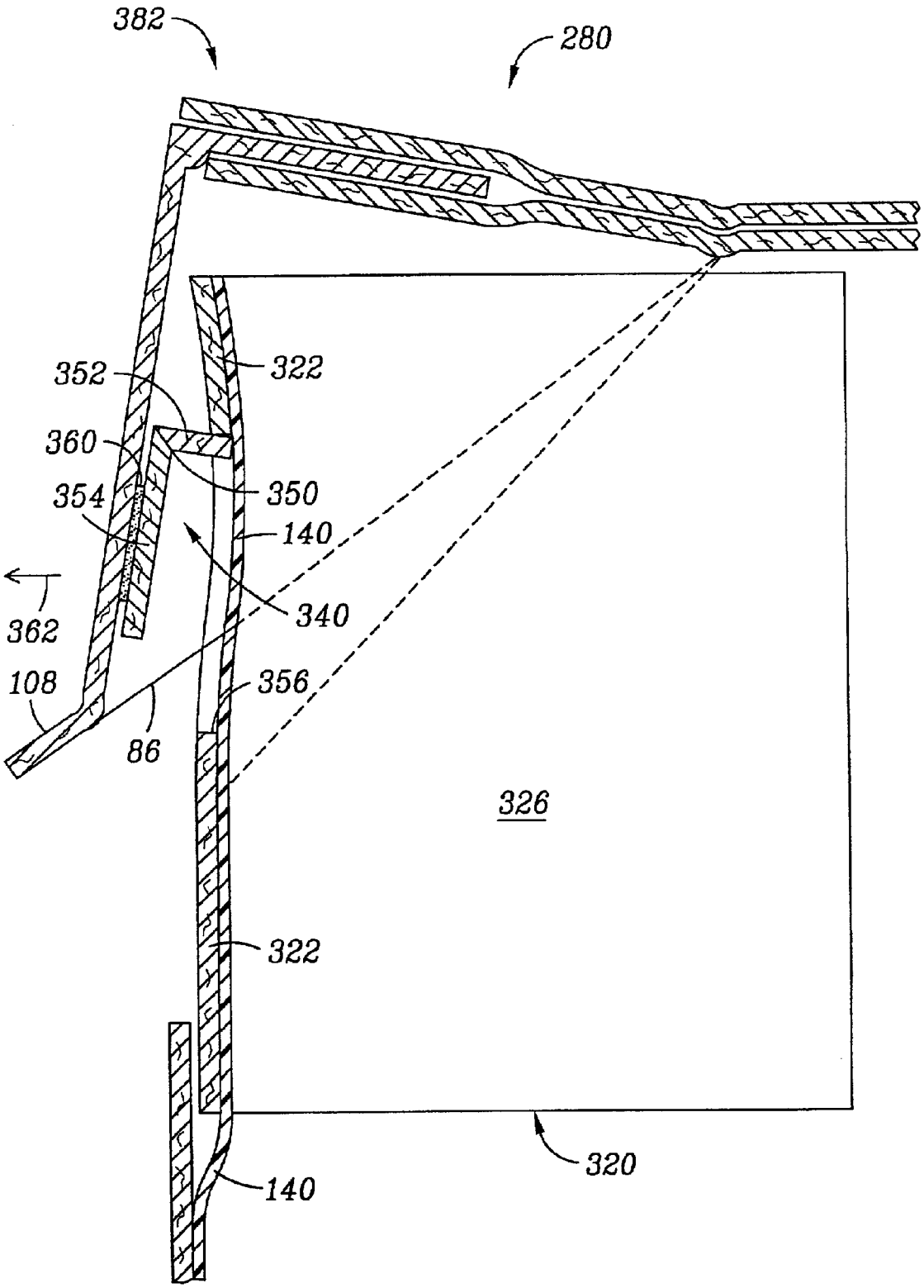
FIG. 16 is a partial cross-sectional view similar to FIG. 15, but showing the carton in a partially open condition.
Figure 17:
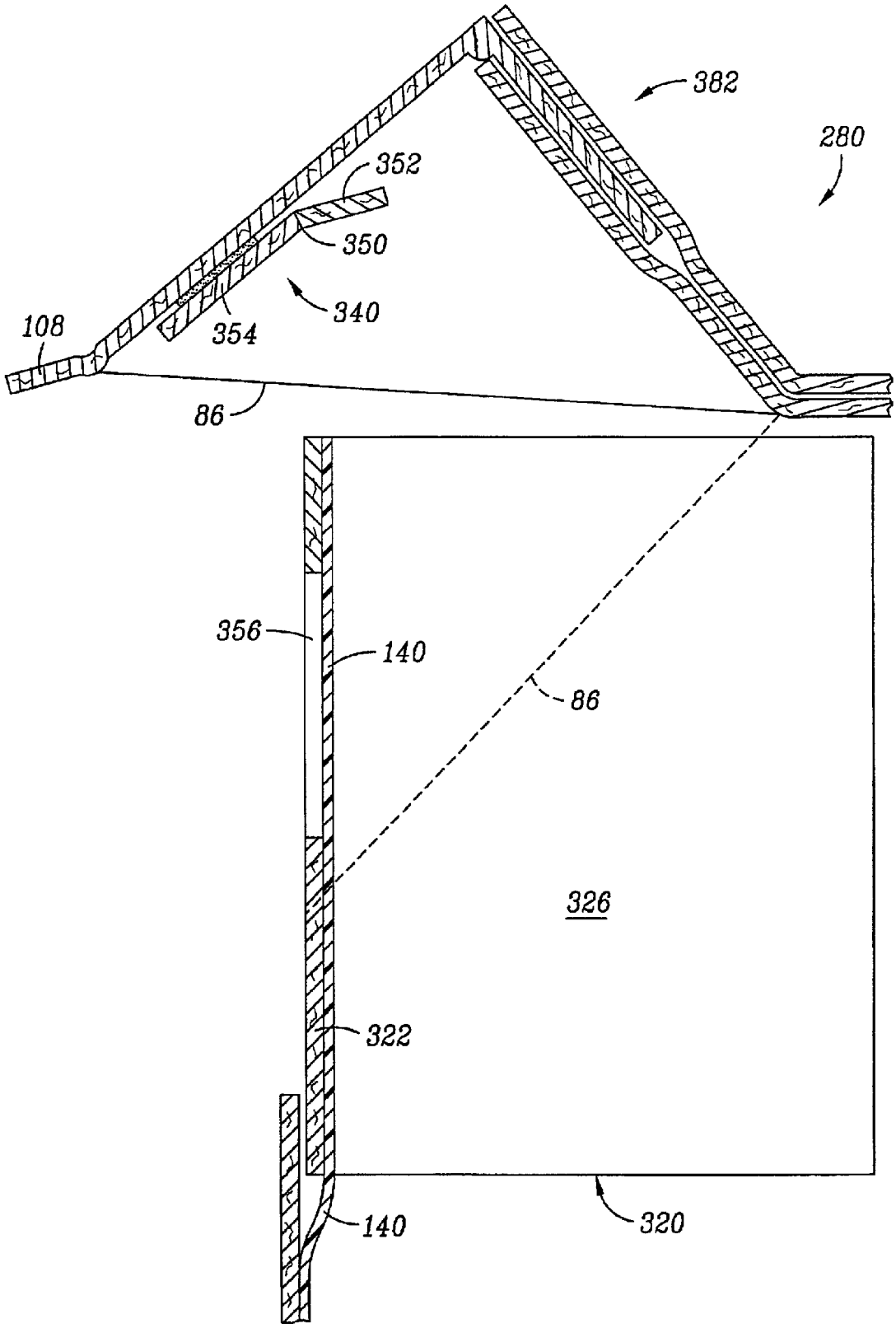
FIG. 17 is a partial cross-sectional view similar to FIGS. 15 and 16, but showing the carton in a further open condition.
Figure 18:
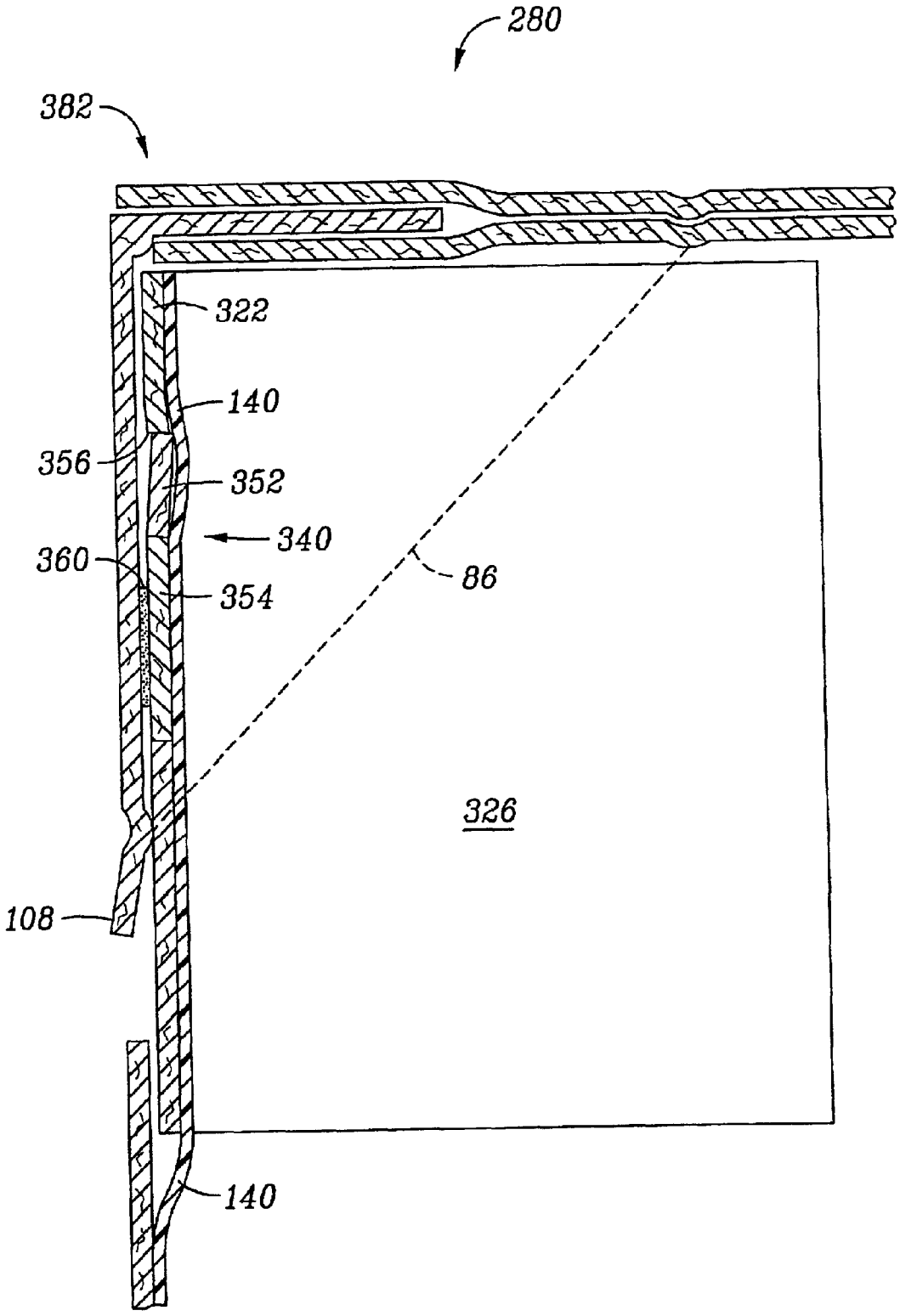
FIG. 18 is a partial cross-sectional view similar to FIGS. 15–17, but showing the carton after it has been re-closed.

After the insert member 320 has been attached to the carton blank 2, as described above, the carton blank may be erected into the carton 280, as illustrated in FIG. 13. FIG. 15 is a cross-sectional view of the carton 280, taken along the line 15—15 of FIG. 13. FIGS. 13 and 15 both illustrate the carton 280 before the flip top lid 382 has initially been opened. FIGS. 16–18 illustrate a sequence of operations through which the flip top lid 382 is opened and then re-closed.

The carton 280 may be initially opened in generally the same manner as the carton 80, previously described. Specifically, to initially open the carton 280, the opening tab 100, FIGS. 13 and 15, may be removed. The tab 108 may then be pulled upwardly, severing the outer layer of the carton 280 along the perforated lines 86 and 92, to the position illustrated in FIG. 16. Referring now to FIG. 16, it can be seen that the movement described above has also caused the cutout portion 340 to separate from the insert member 320, due to the adhesive 360 located between the flip top lid 382 and the stationary portion 354 of the cutout portion 340. Specifically, with reference to FIG. 14, the upward movement of the flip top lid 382 has caused the retention tabs 346 and 348 to tear, thus allowing the cutout portion 340 to completely separate from the remainder of the insert member 320. Referring again to FIG. 16, the upward movement of the flip top lid 382 also causes the hinge portion 352 of the cutout portion 340 to bend about the score line 350, due to the interaction between the hinge portion 352 and the upper edge of the opening 356. As can be appreciated from FIG. 16, although separation of the cutout portion 340 forms the opening 356 through the insert member 320, the sheet 140 still spans the opening 356.

FIG. 17 illustrates the flip top lid 382 in a further opened condition. Referring to FIG. 17, it can be seen that the hinge portion 352 is completely disengaged from the opening 356, but still maintains a nonaligned orientation with respect to the stationary portion 354. The hinge portion 352 is biased toward this nonaligned orientation due to the score line 350 and the bending action imposed on the hinge portion 352 during opening of the lid 382, as illustrated in FIG. 16.

After the desired amount of product has been dispensed from the open carton 280, the flip top lid 382 may be re-closed. This re-closed condition is illustrated in FIG. 18. As can be seen from FIG. 18, when the flip top lid is returned to its closed position, the hinge portion 352 will engage beneath the upper edge of the opening 356. This engagement, in turn, causes the lid 382 to resist reopening and, thus, tends to maintain the lid in its closed condition, as illustrated in FIG. 18.

When it is desired to reopen the flip top lid 382, e.g., to dispense further product from the container 280, the tab 108 may again be pulled upwardly, thus causing the flip top lid 382 to once again move through the sequence illustrated in FIGS. 16 and 17. As can be appreciated from the above, the cutout portion 340 serves to maintain the flip top lid 382 in its closed position after the lid has initially been opened but allows the lid to be reopened when desired.

It is noted that, in addition to holding the lid in its closed position, the stay-closed feature described above also results in an audible "click" when the lid reaches its closed position. This click is caused when, as the lid is moving downwardly to its closed position, the hinge portion 352 springs into the opening 356. This feature is beneficial in that it provides a user of the carton 280 with an audible signal indicating that the lid has reached its fully closed position. The audible click discussed above is caused, in part, by the hinge portion 352 springing past the edge of the opening 356. The volume of the audible click is also, however, enhanced by the hinge portion 352 forcefully contacting the sheet 140, as illustrated in FIG. 18. Accordingly, the existence of the sheet 140 in the vicinity of the opening 356 enhances the audible signal provided.

The existence of the sheet 140 in the vicinity of the opening 356 is also advantageous in that it seals the opening 356 and, thus, prevents product housed withing the carton 280 from exiting the carton through the opening 356. The existence of the sheet 140 is further advantageous in that it prevents the hinge portion 352 from penetrating too far into the opening 356, see FIG. 16. In some situations, such excessive penetration by the hinge portion 352 may interfere with proper reopening of the flip top lid 382. As can be appreciated with reference to FIG. 16, in limiting the penetration by the hinge portion 352, the sheet 140 imposes a resilient force (in the direction of the arrow 362) on the flip top lid 382. This resilient force causes the flip top lid 382 to be biased toward its closed position until the hinge portion 352 disengages from the opening 356 during opening of the flip top lid 382. This biasing of the flip top lid, in turn, causes the flip top lid to tend to remain in its closed position until a sufficient opening force is applied and, thus, serves to resist accidental opening of the flip top lid 382.

Although, as described above, the existence of the sheet 140 is beneficial in many respects, the carton 280 may, alternatively, be manufactured without the sheet 140. In this case, a relatively small section of material may be provided in order to cover the opening 356. This small section of material may be attached, e.g., by gluing, to the partial sidewall panel 322 of the insert member 320, FIG. 14, in the vicinity of the opening 356. The small section of material may, for example, be formed from the same material as the sheet 140.

The stay closed feature described above is extremely advantageous in that it is easy to manufacture. Specifically, the use of the cutout 340 does not require that any extra folds be provided in the insert member 320. Such folds add complexity when erecting a carton and it is, thus, desirable to minimize them. Referring, for example, to FIG. 17, it can be seen that the hinge portion 352 is partially folded about the score line 350. In other words, the hinge portion 352 is non-aligned with the stationary portion 354. This non-aligned configuration enables the hinge portion 352 to spring into the opening 356 when the flip top lid 382 is re-closed (see FIG. 18) and, thus, is important to proper operation of the stay closed feature. As can be appreciated with respect to FIGS. 15 and 16, this folding of the hinge portion 352 is caused by the opening of the flip top lid 382. In other words, before the flip top lid is initially opened (FIG. 15), the hinge portion 352 is not folded about the score line 350. Rather, the opening force supplied to the flip top lid 382 by a user causes the folding to occur. Accordingly, the fold does not have to be formed on the production line for forming the carton 280. This, in turn, simplifies the carton forming process.

The described stay closed feature is further advantageous in that no additional material is required in its formation. Specifically, as described above, the cutout portion 340, which includes the hinge portion 352, is removed from an existing portion of the insert member 320. Accordingly, no additional material is required to form the cutout portion 340. Additionally, because the cutout portion 340 is located on the inside of the flip top lid panel **6*a*, it is never readily visible to a consumer of the product packaged within the carton 280**. Accordingly, the design of the stay closed feature described herein facilitates the aesthetic appearance of the carton.

It is noted that, although the stay-closed feature has been described in conjunction with the stay open feature of FIGS. 1–12 for illustration purposes, it is to be understood that either the stay closed feature or the stay open feature could, alternatively, be used independently of each other. It is further noted that, although, for illustration purposes, the stay closed feature is illustrated as being elliptical in shape, it could, alternatively, be any other shape, such as rectangular or round.

Figure 19:
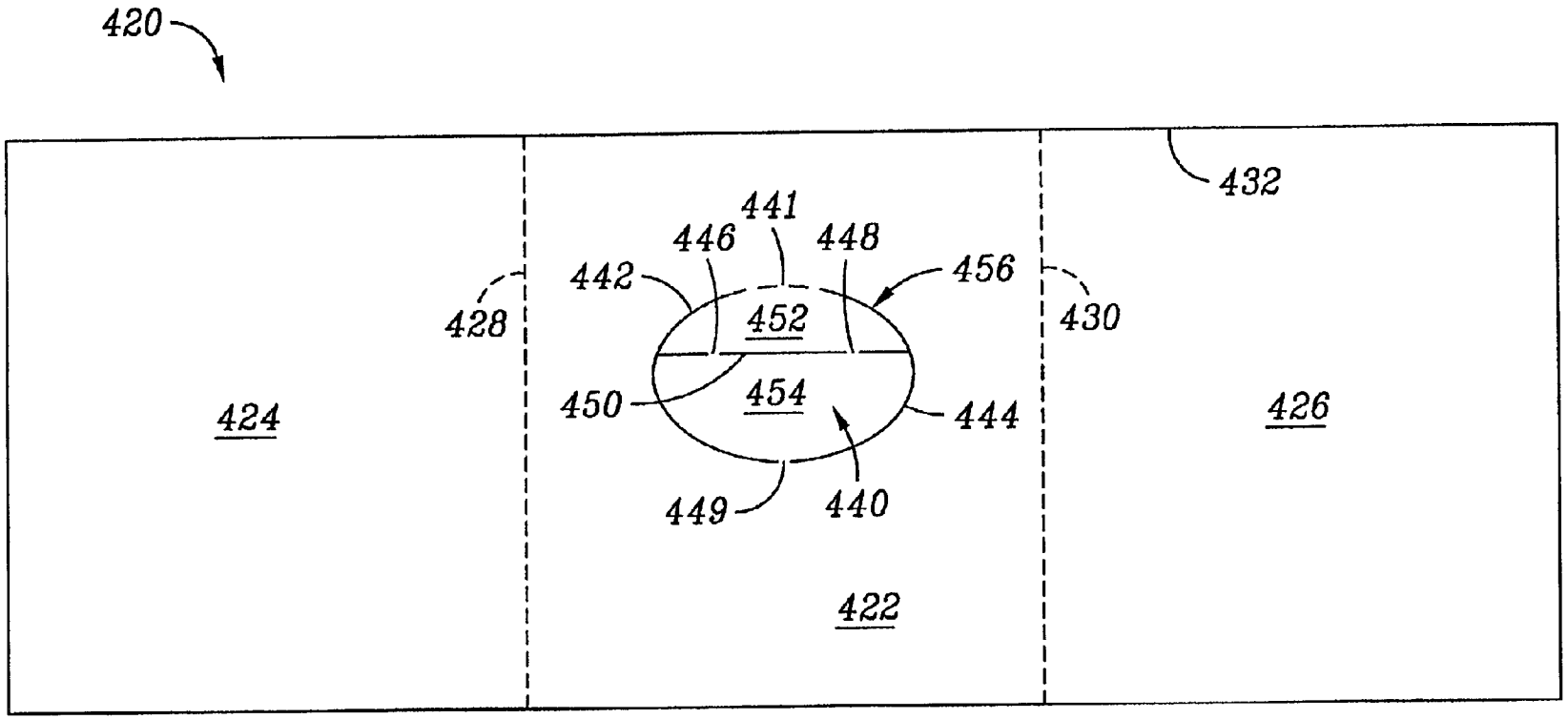
FIG. 19 is a plan view of an insert member used in a carton having an alternative stay closed feature.

FIGS. 19–22 illustrate an alternative embodiment of the stay closed feature in which the hinge portion remains attached to the insert member. Referring first to FIG. 19, an insert member 420 may be provided which is similar to the insert member 320 previously described with respect to FIGS. 13–18. The insert member 420 may have a partial sidewall panel 422; a partial sidewall panel 424 and a partial sidewall panel 426. The partial sidewall panel 424 and the partial sidewall panel 426 may be integral with the partial sidewall panel 422 and may be joined thereto by the fold lines 428 and 430. The insert member 420 has an upper edge 432. The insert member 420 may, for example, be formed from the same material as previously described with respect to the insert members 120 and 320. A latch mechanism 440 may be provided in the partial sidewall panel 422 of the insert member 420 as shown. The latch mechanism 440 may generally be defined by an upper score line 441, a first cut line 442 and a second cut line 444. A third cut line 450 may extend across the latch mechanism 440 and intersecting both the first and second cut lines 442, 444, as shown, dividing the latch mechanism 440 into an upper (as viewed in FIG. 19) hinge portion 452 and a lower stationary portion 454. The cut lines 442, 444, 450 may extend completely through the material forming the insert member 420 such that, together, the cut lines 442, 444, 450 will form an opening 456 in the insert member 420 after the stationary portion 454 is removed, as will be described in further detail herein. A pair of uncut areas may be located within the cut line 450 forming retention tabs 446 and 448. A further retention tab 449 may be provided between the first and second cut lines 442, 444, as shown. The retention tabs 446, 448, 449 serve to retain the stationary portion 454 to the remainder of the hinge portion 452 and the remainder of the insert member 420 during manufacture of a carton embodying the insert member 420.

The insert member 420 may be assembled into the carton blank 2 in substantially the same manner as previously described with respect to the insert member 320. Specifically, when assembling the insert member 420, adhesive 460, FIG. 20, may be supplied between the insert member stationary portion 454 and the carton blank sidewall panel 6, FIG. 2. In a manner similar to that described with respect to the insert member 320, the rectangular sheet 140 may be secured to the insert member 420 around the periphery of the latch mechanism 440 but not to the latch mechanism itself. Securing the rectangular sheet 140 to the insert member 420 and to the remainder of the carton blank 2 may be accomplished using a conventional glue or by any other conventional mechanism.

Figure 20:
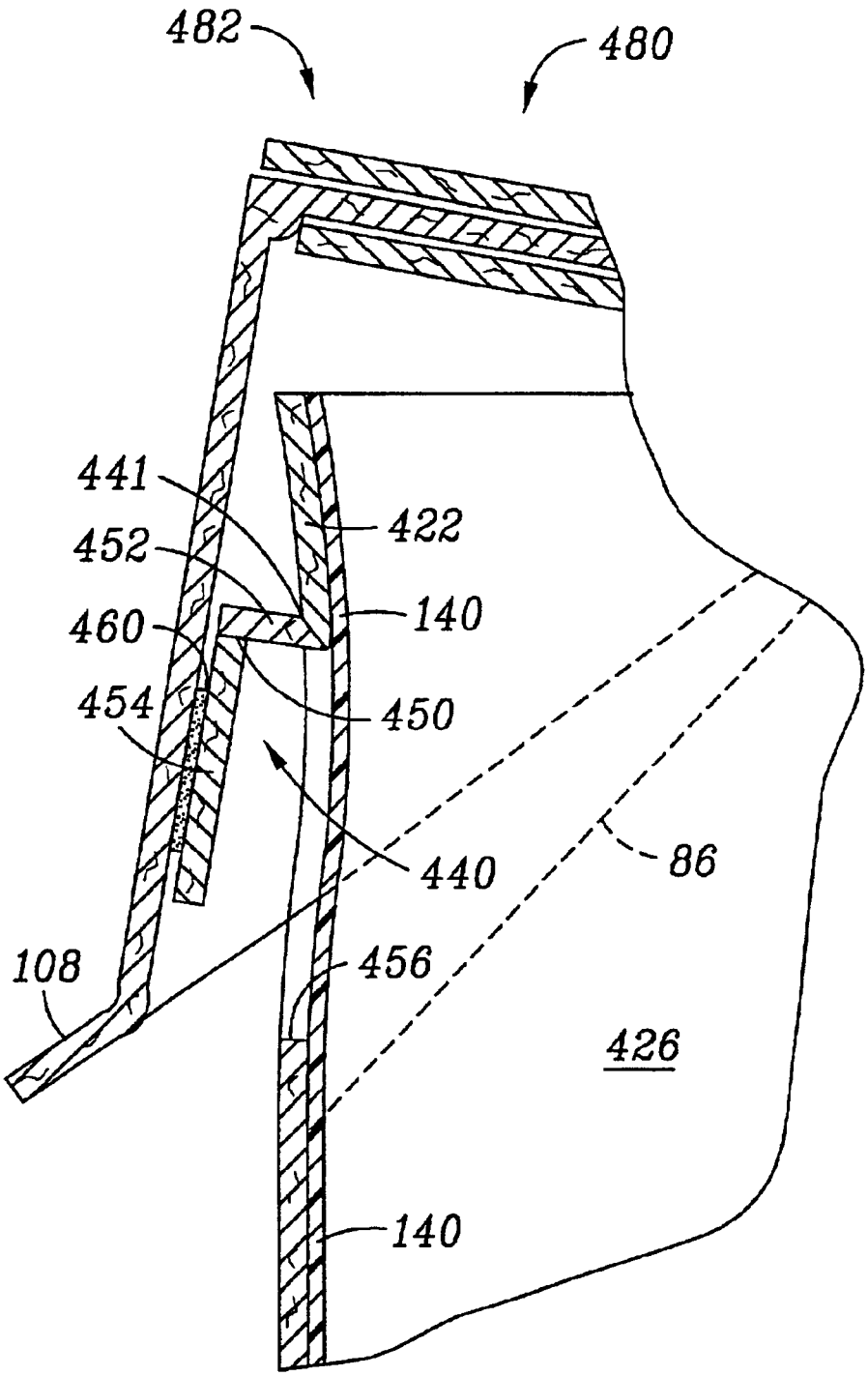
FIG. 20 is a partial cross-sectional view, similar to FIGS. 15–18, but showing a carton including the insert member of FIG. 19 in a partially open condition.
Figure 21:
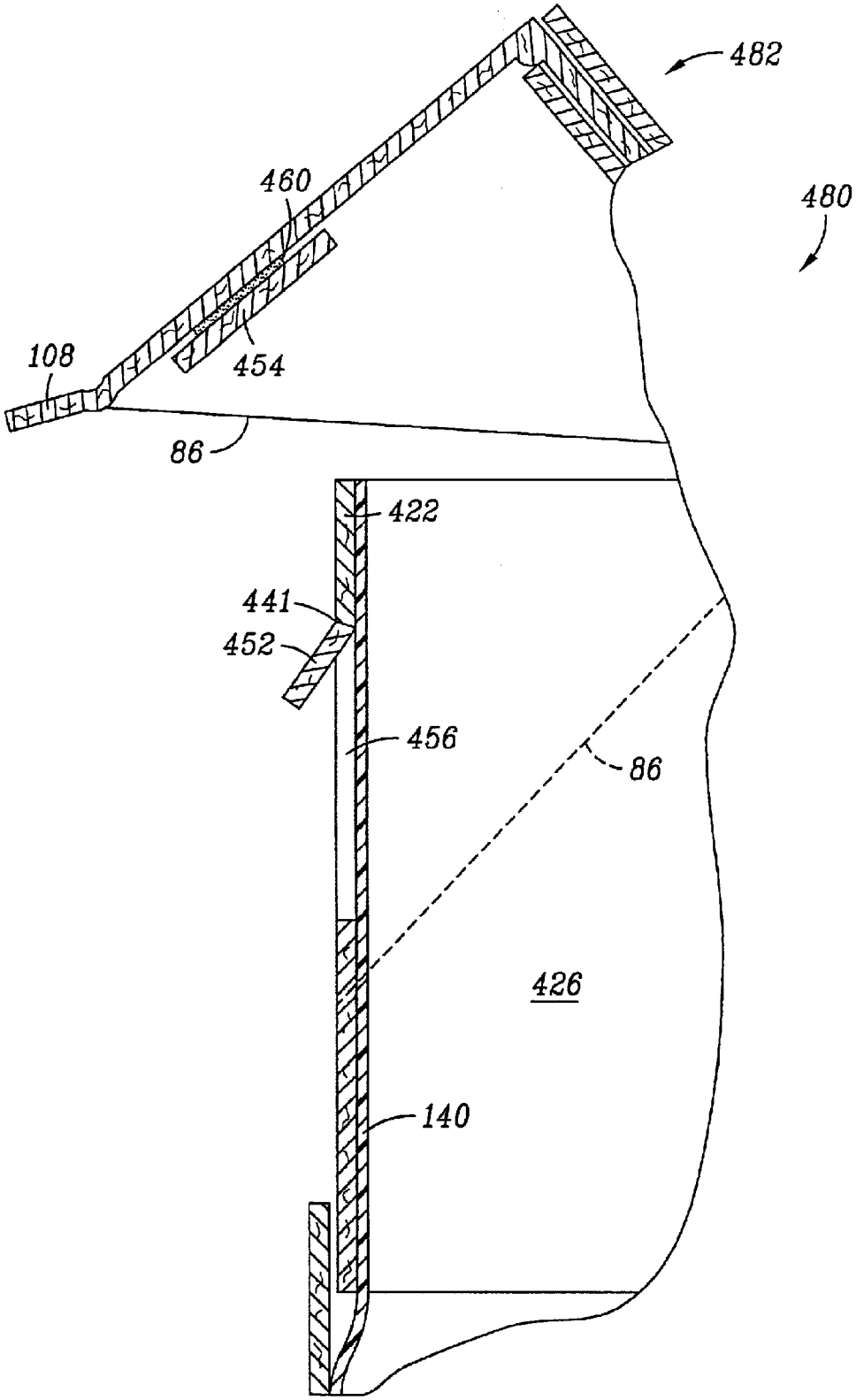
FIG. 21 is a partial cross-sectional view similar to FIG. 20, but showing the carton in a further open condition.
Figure 22:
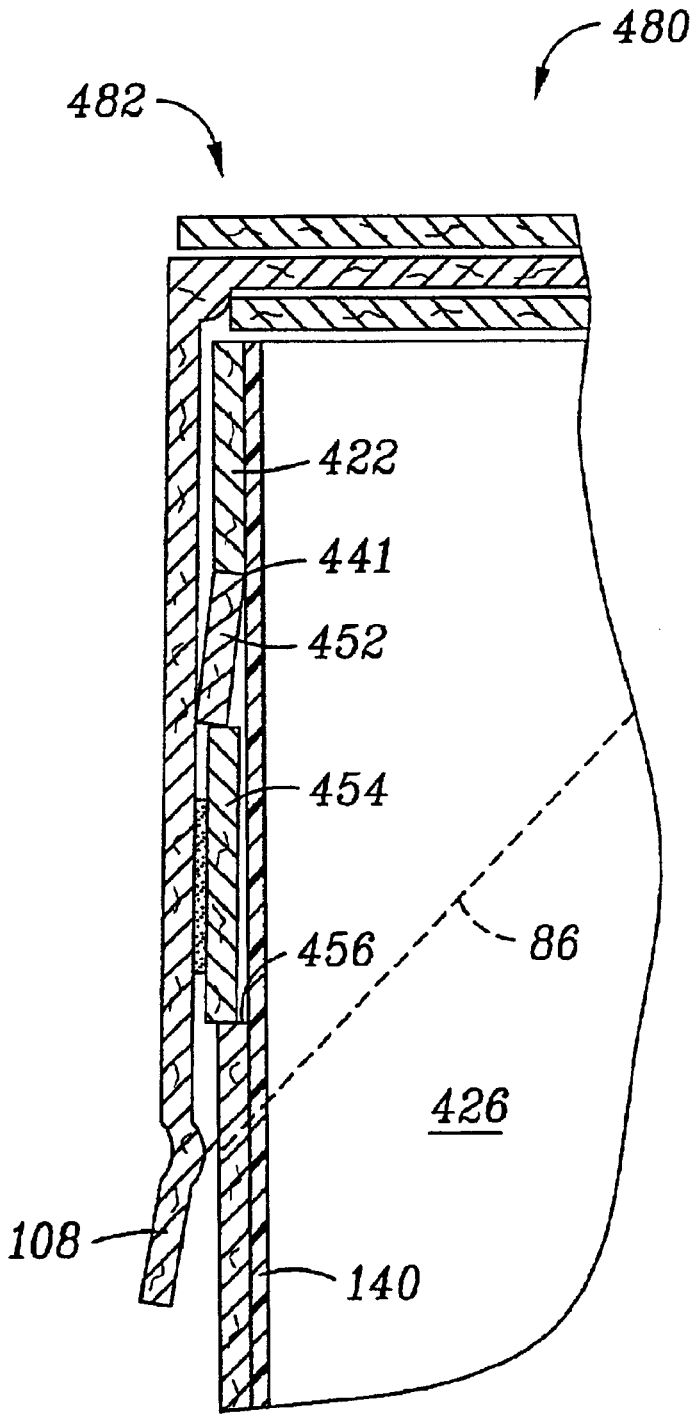
FIG. 22 is a partial cross-sectional view similar to FIGS. 20 and 21, but showing the carton after it has been re-closed.

After the insert member 420 has been attached to the carton blank 2, as described above, the carton blank may be erected into a carton 480 having a flip top lid 482, as illustrated in FIGS. 20–22. FIGS. 20–22, in a similar manner to FIGS. 16–18, illustrate a sequence of operations through which the flip top lid 482 is opened and then re-closed.

The carton 480 may be initially opened in generally the same manner as the cartons 80 and 280, previously described. Specifically, to initially open the carton 480, the opening tab 100, FIGS. 13 and 15, may be removed. The tab 108, e.g., FIG. 20, may then be pulled upwardly, severing the outer layer of the carton 480 along the perforated lines 86 and 92, to the position illustrated in FIG. 20. Referring now to FIG. 20, it can be seen that the movement described above has also caused the stationary portion 454 to separate from the insert member 420, due to the adhesive 460 located between the flip top lid 482 and the stationary portion 454 of the cutout portion 440. Specifically, with reference to FIG. 19, the upward movement of the flip top lid 482 has caused the retention tabs 446, 448 and 449 to tear, thus allowing the stationary portion 454 to completely separate from the remainder of the insert member 420. Referring again to FIG. 20, the upward movement of the flip top lid 482 also causes the hinge portion 452 to bend about the score line 441. As can be appreciated from FIG. 20, although separation of the stationary portion 454 and bending of the hinge portion 452 about the score line 441 forms the opening 456 through the insert member 420, the sheet 140 still spans the opening 456.

FIG. 21 illustrates the flip top lid 482 in a further opened condition. Referring to FIG. 21, it can be seen that the hinge portion 452 maintains a nonaligned orientation with respect to the remainder of the insert member partial sidewall panel 422. The hinge portion 452 is biased toward this nonaligned orientation due to the score line 441 and the bending action imposed on the hinge portion 452 during opening of the lid 482, as illustrated in FIG. 20.

After the desired amount of product has been dispensed from the open carton 480, the flip top lid 482 may be re-closed. This re-closed condition is illustrated in FIG. 22. As can be seen from FIG. 22, when the flip top lid is returned to its closed position, the hinge portion 452 will engage above the upper edge of the stationary portion 454. This engagement, in turn, causes the lid 482 to resist reopening and, thus, tends to maintain the lid in its closed condition.

When it is desired to reopen the flip top lid 382, e.g., to dispense further product from the container 480, the tab 108 may again be pulled upwardly, thus causing the flip top lid 482 to once again move through the sequence illustrated in FIGS. 20 and 21. As can be appreciated from the above, the latch mechanism 440 serves to maintain the flip top lid 482 in its closed position after the lid has initially been opened.

As in the embodiment of FIGS. 13–18, the existence of the sheet 140 in the vicinity of the opening 456 is advantageous in that it seals the opening 46 and, thus, prevents product housed withing the carton 480 from exiting the carton through the opening 456. Although the existence of the sheet 140 is beneficial in many respects, the carton 480, like the carton 280, may, alternatively, be manufactured without the sheet 140. In this case, a relatively small section of material may be provided in order to cover the opening 456. This small section of material may be attached, e.g., by gluing, to the partial sidewall panel 422 of the insert member 420, FIG. 19, in the vicinity of the opening 456. The small section of material may, for example, be formed from the same material as the sheet 140.

As in the embodiment of FIGS. 13–18, the stay closed feature of FIGS. 19–22 is extremely advantageous in that it is easy to manufacture. Specifically, the use of the latch mechanism 440 does not require that any extra folds be provided in the insert member 420. Such folds add complexity when erecting a carton and it is, thus, desirable to minimize them. Referring, for example, to FIG. 21, it can be seen that the hinge portion 452 is partially folded about the score line 441. In other words, the hinge portion 452 is non-aligned with the remainder of the partial sidewall panel 422 of the insert member 420. This non-aligned configuration enables the hinge portion 452 to spring into contact with the stationary portion 454 when the flip top lid 482 is re-closed (see FIG. 22) and, thus, is important to proper operation of the stay closed feature. As can be appreciated with respect to FIG. 20, this folding of the hinge portion 452 is caused by the opening of the flip top lid 482. In other words, before the flip top lid is initially opened, the hinge portion 452 is not folded about the score line 441. Rather, the opening force supplied to the flip top lid 482 by a user causes the folding to occur. Accordingly, the fold does not have to be formed on the production line for forming the carton 480. This, in turn, simplifies the carton forming process.

The described stay closed feature is further extremely advantageous in that no additional material is required in its formation. Specifically, as described above, the latch mechanism 440, which includes the hinge portion 452, is removed from an existing portion of the insert member 420. Accordingly, no additional material is required to form the latch mechanism 440.

It is noted that, although the stay-closed feature of FIGS. 19–22 has been described in conjunction with the stay open feature of FIGS. 1–12 for illustration purposes, it is to be understood that either the stay closed feature or the stay open feature could, alternatively, be used independently of each other. It is further noted that, although, for illustration purposes, the stay closed feature of FIGS. 19–22 is illustrated as being elliptical in shape, it could, alternatively, be any other shape, such as rectangular or round.

It is contemplated that the concepts herein described may be variously otherwise embodied and it is intended that the appended claims be construed to include alternative embodiments except insofar as limited by the prior art.

What is claimed is:

1. A method of opening and closing a container, said method comprising:

providing said container comprising:

a body portion having at least one wall;

a dispensing opening;

a lid movably attached to said body portion;

a panel formed in said at least one wail of said body portion;

wherein said panel is attached to said lid;

moving said container to an open condition, in which product can be dispensed from said container through said dispensing opening, by applying an opening force to said lid, wherein said opening force causes said panel to separate from said at least one wall, thereby forming a hole in said at least one wall;

moving said container to a closed condition by applying a closing force to said lid;

releasably retaining said container in said closed condition by engaging at least a portion of said panel with at least a portion of said wall;

wherein said container further comprises a sheet of material covering said hole while said container is in said open condition;

wherein, said panel includes a stationary portion and a hinge portion separated from said stationary portion by a score line;

wherein, said stationary portion is attached to said lid; and wherein, said engaging at least a portion of said panel with at least a portion of said wall comprises engaging said hinge portion with said at least a portion of said wall.

2. The method of claim 1 wherein said lid is a flip top lid.

3. The method of claim 1 wherein said sheet of material is a sheet of fluid impervious material.

4. The method of claim 1 wherein said engaging at least a portion of said panel with at least a portion of said wall comprises engaging said at least a portion of said panel with at least a portion of said wall within said hole.

5. A container comprising:

a body portion having at least one wall;

a dispensing opening;

a lid movably attached to said body portion;

wherein said container includes a first condition before said container has initially been opened, a second open condition and a third re-closed condition;

wherein, in said first condition, a panel is attached to both said at least one wall of said body portion and said lid;

wherein in said second condition, said panel remains attached to said lid but has been removed from said at least one wall, thus leaving a hole in said at least one wall;

wherein, in said third condition, at least a portion of said panel is releasably engaged with at least a portion of said wall;

a sheet of material coring said hole while said container is in said second open condition;

wherein, sad panel Includes a stationary portion and a hinge portion separated from said stationary portion by a score line;

wherein, said stationary portion is attached to said lid; and wherein said at least a portion of said panel comprises said hinge portion.

6. The container of claim 5 wherein said lid is a flip top lid.

7. The container of claim 5 wherein said sheet of material is a sheet of fluid impervious material.

* * * * *